US005326191A

United States Patent [19]

Wilson et al.

[11] Patent Number: 5,326,191

[45] Date of Patent: Jul. 5, 1994

[54] REINFORCED METAL BOX CULVERT

[75] Inventors: Michael W. Wilson, New Brunswick; Thomas C. McCavour, Etobicoke, both of Canada

[73] Assignee: Michael M. Wilson, New Brunswick, Canada

[21] Appl. No.: 26,860

[22] Filed: Mar. 5, 1993

[51] Int. Cl.[5] ..... E01F 5/00

[52] U.S. Cl. ..... 405/124; 405/126

[58] Field of Search ..... 405/124, 125, 126, 150.1, 405/151

[56] References Cited

U.S. PATENT DOCUMENTS

| | | | |
|---|---|---|---|
| 4,141,666 | 2/1979 | DeGraff | 405/126 |
| 4,318,635 | 3/1982 | Gurtner | 405/126 |
| 5,118,216 | 6/1992 | Musser | 405/124 |
| 5,118,218 | 6/1992 | Musser | 405/124 |

FOREIGN PATENT DOCUMENTS 2657229 7/1977 Fed. Rep. of Germany .

*Primary Examiner*—David H. Corbin

*Attorney, Agent, or Firm*—Lee, Mann, Smith, McWilliams, Sweeney & Ohlson

[57] ABSTRACT

A reinforced metal box culvert is provided which has the standard crown, opposing sides and opposite curved haunches. The culvert is characterized in having continuous corrugated metal sheet reinforcement secured to at least the crown of the culvert and extends the length of the culvert which is effective in supporting the load. The corrugated reinforcement has a profile which abuts the crown corrugations with the troughs of the reinforcement being secured to the crests of the corrugated crown. The corrugated reinforcement sheet has a curvature complementary to the corrugated crown to facilitate securement. The continuous reinforcement, as secured to the culvert in an uninterrupted manner, provides an optimum load carrying capacity for selected extent of reinforcement provided by the reinforcement metal sheets.

20 Claims, 6 Drawing Sheets

FIG. 1. PRIOR ART.
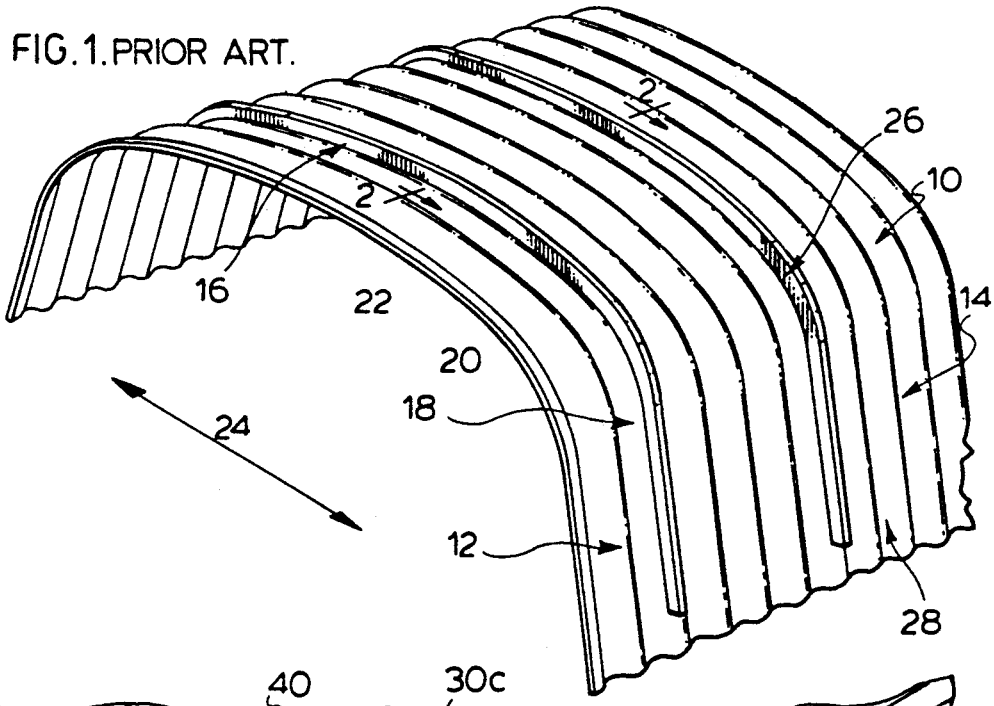
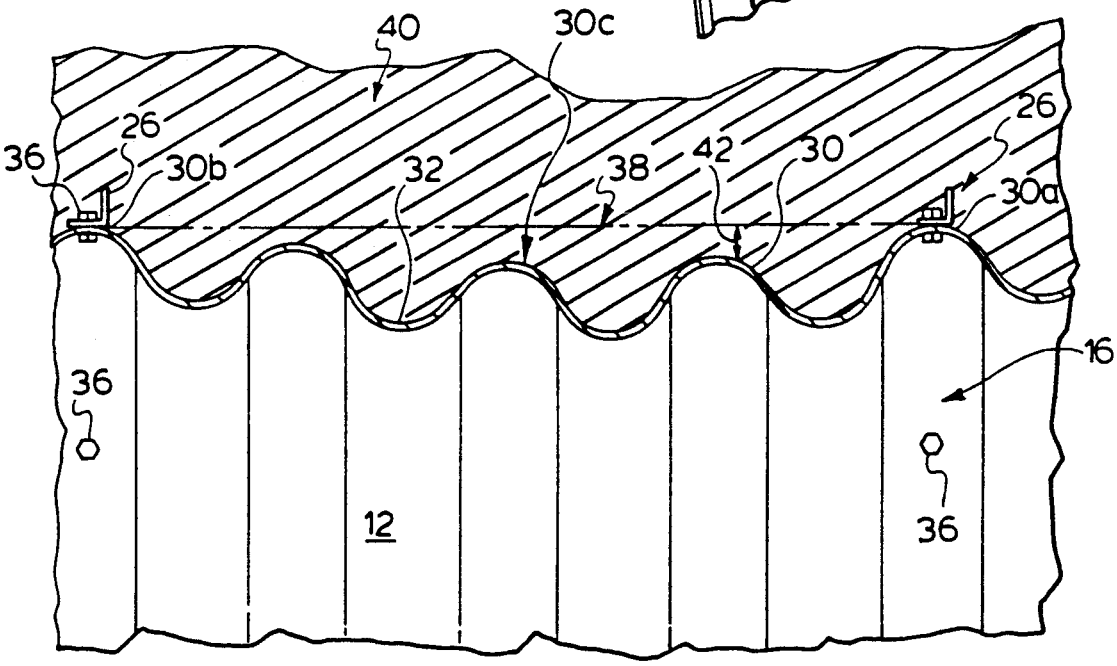
FIG. 2. PRIOR ART.

REINFORCED METAL BOX CULVERT

FIELD OF THE INVENTION

This invention relates to box culvert design and more particularly to a reinforced metal box culvert optionally mounted on a secure corrugated metal footing pad.

BACKGROUND OF THE INVENTION

Culvert design over the last 20 to 30 years has advanced considerably, particularly with respect to large diameter culverts, box culverts and re-entrant arch shaped culverts. Corrugated metal culverts of large diameter have gained general acceptance for use under roadways, railways and the like. Circular culverts have significant drawbacks associated with waterway installations because the stream bed must be disturbed. In order to reduce the impact on the stream bed, arch structures are preferred. The arch structure has an open base and as such relies on a set of design requirements different from circular culverts for supporting the overbearing load. Arch structures have a large radius crown and usually have straight sides as associated with the box culvert. Box culverts are particularly useful in meeting a need for structures with large cross-sectional areas for water conveyance with limited vertical clearance. Normally, metal box culverts are made of either aluminum or steel. Usually the plate which is used in the culverts is corrugated to strengthen the design. The corrugated plate, particularly if it is aluminum, is usually strengthened by reinforcing ribs or the like at intervals along the culvert length.

An example of this type of rib reinforced aluminum culvert design is disclosed in U.S. Pat. No. 4,141,666 issued to Kaiser Aluminum and Chemical Corporation. The use of reinforcing members on the outside of the box culvert provides for the necessary load carrying capacity. However, sections between the reinforcing members are considerably weaker and hence, when loaded, there is a differential deflection or undulating effect along the length of the culvert. To reduce this problem, unitary extrusions are secured to the inside of the culvert to reduce undulation, particularly along the crown and base portions. It is understood however that when box culverts are used over stream beds or the like, it is not desirable to include inside the culvert any attachments particularly used in reinforcing culvert design structures because they tend to be destroyed during ice flows and floods.

The use of strengthening ribs has also been applied to metal box culverts, such as disclosed in U.S. Pat. No. 4,318,635. Multiple arched-shaped reinforcing ribs are applied to the culvert interior and/or exterior to provide for reinforcement in the sides, crown and intermediate haunch portions. However, such spaced apart reinforcing ribs, although they enhance the strength of the structure to resist load do not overcome undulation problems in the structure and can add unnecessary weight to the structure by virtue of superfluous reinforcement.

U.S. Pat. No. 5,118,218 discloses a box culvert design which does not involve the use of reinforcing members. Instead, the sheets of metal used in constructing the culvert have exceptionally deep corrugations of a depth in the range of 100 to 150 nm with a pitch in the range from 300 to 450 mm. By using significantly thicker material in the crown portions of the culvert and perhaps as well in the haunch portions of the culvert, significant loads can be carried by the culvert design. However, significant limitations exist with respect to the crown in regard to radius of curvature. Radius of curvature of less than 1 m is avoided with steel because of the significant potential for microcracking and fissuring due to cold working or strain hardening when bending the steel to the desired radius of curvature. With aluminum, the shorter radius of curvature is avoided because of the possible permanent deformation of the cross-section during forming due to the lower modulus of elasticity. Furthermore, the use of thicker metal in the crown or haunch portions of the culvert without reinforcing can add considerably to the overall weight of the structure in order to carry design loads. Metal box culverts are usually designed using plastic theory rather than elastic theory. It is generally accepted that one of the significant drawbacks with existing box culvert designs is that one cannot take full advantage of the plastic theory.

The elastic theory of design requires that the design be based on the allowable stress method whereas the plastic theory of design considers the greatest load which can be carried by the structure when acting as a unitary structure. The advantage in a plastic design procedure is that there is a possibility of significant saving in the amount of metal required and hence, permit culvert design which can give a more accurate estimate of the amount of load that a structure can support. Metal box culverts are often subject to large stresses which are difficult to predict such as those caused by and erection of the structure and subsequent structure settlement. Plastic design criteria however provides for such situations by permitting plastic deformation in the structure. The plastic moment is generally understood to be the moment which will produce plasticity in a member of the box culvert and create a plastic hinge. In design of metal box culverts, plastic moments are distributed between the crown and the haunch. Theoretically, this distribution could be as unbalanced as 0 to the haunch and 100% to the crown which would resemble a simple supported beam. However, current practice in design restricts the distribution to 45% minimum and 70% maximum to the crown. Current design specifications such as AASHTO publish the required plastic moment capacity for the crown and haunch of metal box culverts. These specifications cover spans from 2.5 m to 8 m and cover depths of overload from 0.4 m to 1.5 m In the metal box culvert designs which are reinforced with metal stiffening ribs, there is a complex interaction of the stiffener ribs with the corrugated plate. The section properties at each metal rib provide greater inertia or stiffness at the ribs. The corrugated plate functions as a membrane between the ribs and transfers loads to the ribs. The corrugated plate between the ribs is then subjected to axial stress on two axis or about two axis that is circumferential and transverse. Because of this complex interaction, a rational analysis is difficult and hence there is a need to move towards the plastic design of a section with uniform stiffness and subject to stress on only one axis.

In unreinforced metal box culverts, the difference in plastic moment between the crown and haunch is achieved by changing the thickness of the corrugated plate. In the case of the shallow depth of cover, the plastic moment at the crown is usually much greater than the plastic moment at the haunch resulting in a crown plate thickness usually greater than the haunch plate thickness. In the case of deep covers over the culvert, say in the range of 1.5 m, the plastic moment at the crown can be equal to the plastic moment of the haunch. In ureinforced metal box culvert design the selection of corrugation profile and metal thickness is based on providing the appropriate plastic moment resistance at the haunch or crown. At all other locations more material is provided than necessary and hence, the significant addition of weight to the structure as well as increased costs in manufacture and material costs.

It has also been found that the 8 m limitation with respect to span of existing metal box culvert designs is overly restrictive for the culvert designer. There are several situations where a span of 8 m or greater would be desired. However, with existing culvert design, such spans cannot be achieved. Any attempt to reduce the load above the culvert, such as the use of concrete slabs at surface level or below surface level, but spaced above the culvert crown, considerably increases the total cost of the metal box culvert installation, particularly in regions where concrete may not be readily available. Concrete has also been used to reinforce culvert bases such as disclosed in German patent application 26 57 229. The concrete is retained in position by an outer skin of corrugated metal spaced from the culvert by the concrete thickness. However, the concrete reduces the ductility of the structure and prevents thereby the redistribution of plastic moments and the application of plastic theory.

The continuously reinforced box culvert design of this invention has significant advantages over the prior art and allows one to achieve plastic design procedures while avoiding the problems associated with the unreinforced or reinforced culvert designs.

SUMMARY OF THE INVENTION

According to an aspect of the invention, in the normal reinforced metal box culvert which is characterized by having a crown, opposing sides and opposite curved haunches, each haunch is intermediate the crown and a corresponding side. Normally, in reinforced culvert designs, there are spaced apart reinforcement members applied to the exterior portions of the box culvert sides, haunches and crown. The box culvert has the crown, opposing sides and opposite haunches of corrugated metal sheet sections which are of the same or different thickness in metal and have similar corrugation profiles. The metal sheet corrugation extends parallel to the culvert span and the metal sheets are secured in nested overlapping relation. The improvement comprises:

i) a currugated metal sheet reinforcement secured to at least the crown and extending continuously along the crown for the culvert length which is effectively supporting load, ii) the corrugated reinforcement sheet has a corrugation profile which abuts the at least corrugated crown with troughs of the reinforcement sheet secured to crests of the at least corrugated crown along culvert length, iii) the corrugated reinforcement sheet has a curvature complementary to the at least currugated crown to facilitate thereby securement of the troughs abutting the crests, iv) the reinforcement metal sheet extending continuously along the culvert in an uninterrupted manner to provide an optimum load carrying capacity for a selected extent of reinforcement provided by the reinforcement metal sheet secured to the at least corrugated crown.

BRIEF DESCRIPTION OF THE DRAWINGS

Preferred embodiments of the invention are shown in the drawings wherein:

FIG. 1 is a perspective view of a prior art rib reinforced box culvert design, in accordance with the prior art.

FIG. 2 is a section along the lines 2—2 with backfill shown in place.

DETAILED DESCRIPTIONS OF THE PREFERRED EMBODIMENTS

Figure 3:
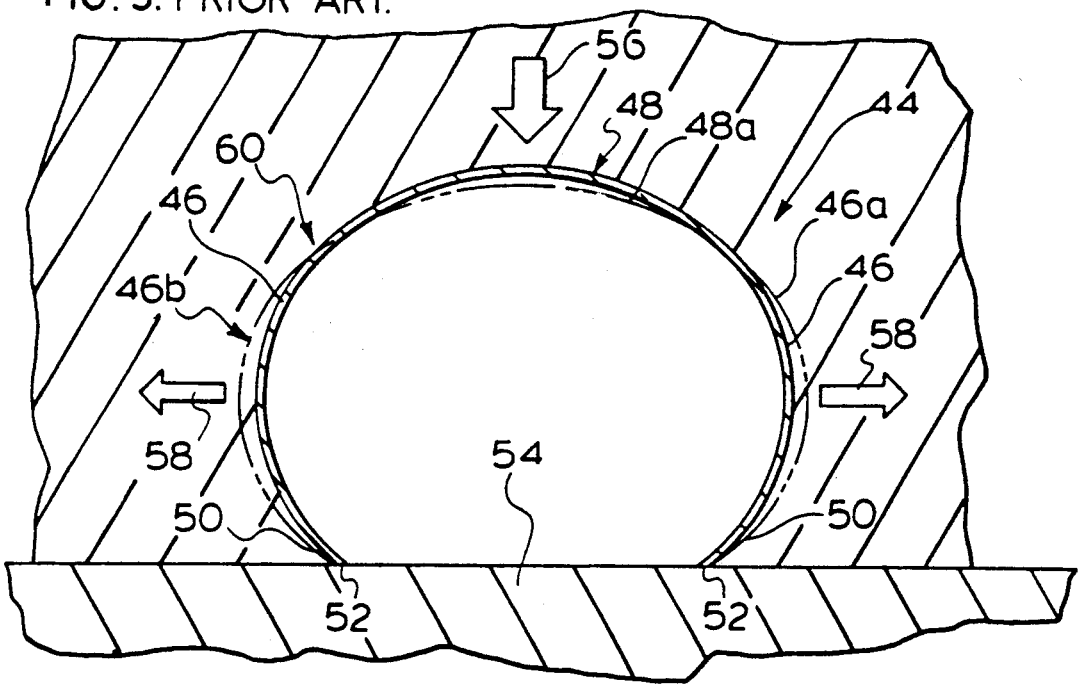
FIG. 3. PRIOR ART.
FIG. 3 is a section through a prior art re-entrant arch culvert.

Existing box culvert designs continue to have several drawbacks and/or structural design flaws. However, such drawbacks and design flaws have been overcome by limiting the span of the box culverts and using special configurations of reinforcement ribs. The approach to reinforcement provided by this invention overcomes the above problems by providing a structure based on plastic design criteria.

In order to appreciate and understand the several advantages and features of this invention, it is necessary to review certain structural problems with existing prior art culverts shown in FIGS. 1, 2, 3 and 4. With reference to FIG. 1, a reinforced box culvert 10 is shown in position. Reinforced box culverts have the normal sections of corrugated metal sheet 12. These sheets may be of varying length and constitute the sidewall portions 14, the crown portion 16 and the intermediate haunch portions 18. Normally, the various sheets 12 having been bent to take on the profile of the sidewall, haunch or crown are secured together in staggered relationship to form a complete structure. The staggered relationship is shown with respect to seam 20 being offset from seam 22. The sections are also secured together along the length of the corrugations which extend in the direction of the span indicated by arrow 24 of the culvert. These sections are secured in overlapped relationship by the use of bolts which extend through aligned holes pre-punched or drilled on site in the corrugated sheet metal sections. It is also understood that the sheet metal of this type of culvert may be of either corrugated steel or aluminum sheet or plate.

In order to achieve the necessary load carrying capacity for larger spans in the direction of arrow 24, it has been found necessary to reinforce the culvert sections. Typical reinforcement is applied in the form of reinforcing ribs 26, which extend from the lower portion 28 of each culvert sidewall over the haunch 18 and across the entire crown 16. These metal reinforcing ribs may be of steel or aluminum, which can be formed by extruding, hot rolling or cold forming into various shapes which can be bolted to the box culvert structure. The ribs are spaced apart along the length of the culvert where such spacing may be anywhere from 0.23 m to 1.38 m along the haunch and sidewall portion and at intervals of 0.23 m to 0.46 m long in crown. In the particular case of metal box culverts fabricated from a steel plate, the reinforcement ribs are spaced at intervals of 0.3 m to 1.22 m along the haunch or crown.

Although maximum load carrying capacities are achieved by the use of a reinforcing rib design, there is an inherent problem which at present tends to be ignored when considering the overall load carrying capacities of the structure. As shown in FIG. 2, the crown 16 has a sinusoidal section of crests 30 and troughs 32, which is the generally accepted section of the corrugated plate. The sections of the plate may overlap and the overlapped joint secured together by bolts where sufficient bolts are used to minimize working of one sheet relative to the other and hence provides a unitary structure. Usually with these prior art structures the reinforcing ribs 26 are L shaped to permit ready access in securing the bolts 36 in position where the overlapped joint is located at the stiffening ribs.

The moment capacity of this type of corrugated box metal culvert is not only controlled by the choice of metal and their properties but, as well the use of reinforcing ribs to achieve the necessary large moment capacities as a consequence of their extreme geometry of the shell and depths of cover. Box culverts rely primarily on their own inherent structural characteristics or plastic moment resistance but they also depend secondarily on interaction with the surrounding backfill which restrains the tendency of the sides of the structure to flex outward. This secondary assistance increases the load carrying capacity as compared to that of a free-standing structure with no soil around it. Reinforcing ribs can be relied on to increase the load carrying capacity. The difficulty, however, in using the ribs to achieve the necessary large moment capacities is that deflection of the corrugated sheet between the ribs occurs. This deflection is demonstrated in FIG. 2. A plane indicated by line 38 between the crown portions 30A and 30B is shown in FIG. 2. The interconnected panels 12 when under live and/or dead load through the fill material 40, deflect inwardly of the structure as indicated by crown crest 30C being well below the plane 38 as indicated by arrow 42. The deflection occurs between the reinforcing ribs because the reinforcing ribs constitute a stronger part of the structure so that the load is transferred through the panels 12 to the ribs 26. As a result, an undulating effect along the length of the structure occurs. This undulation along the length of the structure can affect its overall load carrying capacities which is then taken into consideration in designing the final structure. As a result, the use of ribs, although they achieve desired load carrying capacities bring to the structure this unwanted deflection of the panels between the ribs.

The deflection problems associated with box culvert designs can be overcome to some extent by the re-entrant arch culvert 44 of FIG. 3. The re-entrant culvert has curved sides 46 and a curved crown 48. The bottom portions 50 of the sides 46 are secured at 52 to footings provided in the ground. Re-entrant culverts differ from the box culvert of FIG. 1 from a design stand point. The arch culvert which in this situation is a soil-metal structure is usually analyzed using a determinate structure model and which is of elastic design criteria rather than plastic design criteria. As is appreciated by those skilled in the art when a load is applied in a direction of arrow 56, the sides 46 move outwardly as shown in dot at 46A and 46B in the direction of arrows 58. The crown 48 also moves downwardly to position 48A. The outward deflection of the sides 46 is resisted by the properties of the culvert and as well, its interaction with the soil generally designated 60 about the culvert. This soil-metal structure does not require use of reinforcing ribs to withstand heavy design loads but due to its soil interaction and the elastic basis of design, the fill 60 about the culvert has to be of a special grade to ensure that there is the necessary reaction of the soil about the culvert sides to withstand the loads and prevent critical elastic deformation in sides. In not using reinforcing ribs along the re-entrant arch structure, the problems associated with deflection are avoided. However, special fill required in completing the structure may be difficult to obtain or too expensive to provide for remote area installations.

Figure 4:
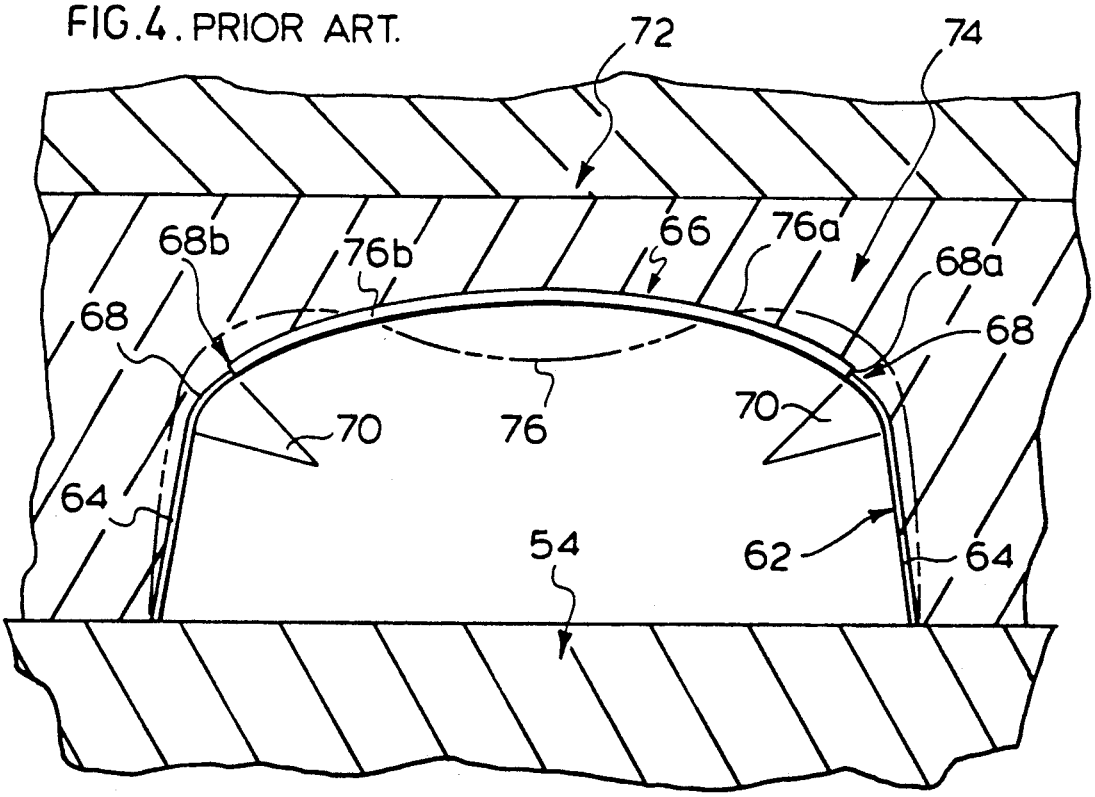
FIG. 4. PRIOR ART.
FIG. 4 is a section through a prior art unreinforced box culvert where the plastic moment diagram is shown in dot when the culvert is subjected to load.

The preferred structure for water conveyance continues to be the box culvert design because of its large cross-sectioned area where vertical clearance is limited, less disturbance to river beds and the ability to be backfilled with any available material because surrounding soil is not relied on for structural purposes. In an effort to overcome the problems associated with deflection, a deep corrugation box culvert design as previously mentioned is provided without any reinforcement to avoid problems associated with deflection of culvert sides. A section of the deep corrugated culvert design is shown in FIG. 4. The culvert 62 has sidewalls 64, a crown 66 and intermediate haunch portions 68. The haunch portions 68 is within the included angles 70. The culvert 62 is the benefit of an indeterminate structure based on plastic design principles. Without the reinforcing ribs, the structure does not have differential deflection along its length. The roadway 72 as provided above the culvert 62 transfers its load to the crown 66 through the overbearing soil 74. For maximum load design, the plastic deformation is shown in dot at 76 where the crown portion 66 carries at least 45% of the load and preferably up to 70% of the load while the haunches carry from a minimum of 30% up to 55% of the load. This difference in the plastic moment between the crown, haunch and side portions in this unreinforced box culvert is achieved by changing the thickness of the crown corrugated sheet and haunch sidewall corrugated sheet. The crown 66 extends from the haunch areas across the top, where its extent is shown in FIG. 4 from 68A to 68B which indicates the upper extent of each haunch 68. There can be problems associated with the use of a heavier crown plate particularly in forming the thicker crown section to tie in with the arch shape of the haunch. However, these problems are overshadowed by the advantages in providing a box culvert of a structure with minimal or no deflection along its length. The crown portion 66 as it extends between the haunch extremities 68A and 68B is all of the same thickness to achieve the consistent properties in the crown. However, considerable weight is added to the structure in view of the thicker material extending beyond points 76A and 76B which indicate the zero moment on each side of the crown 66. However, this additional material has been thought necessary in order to achieve the necessary maximum load carrying capacities for a regulated limited span of less than 8 m.

Figure 5:
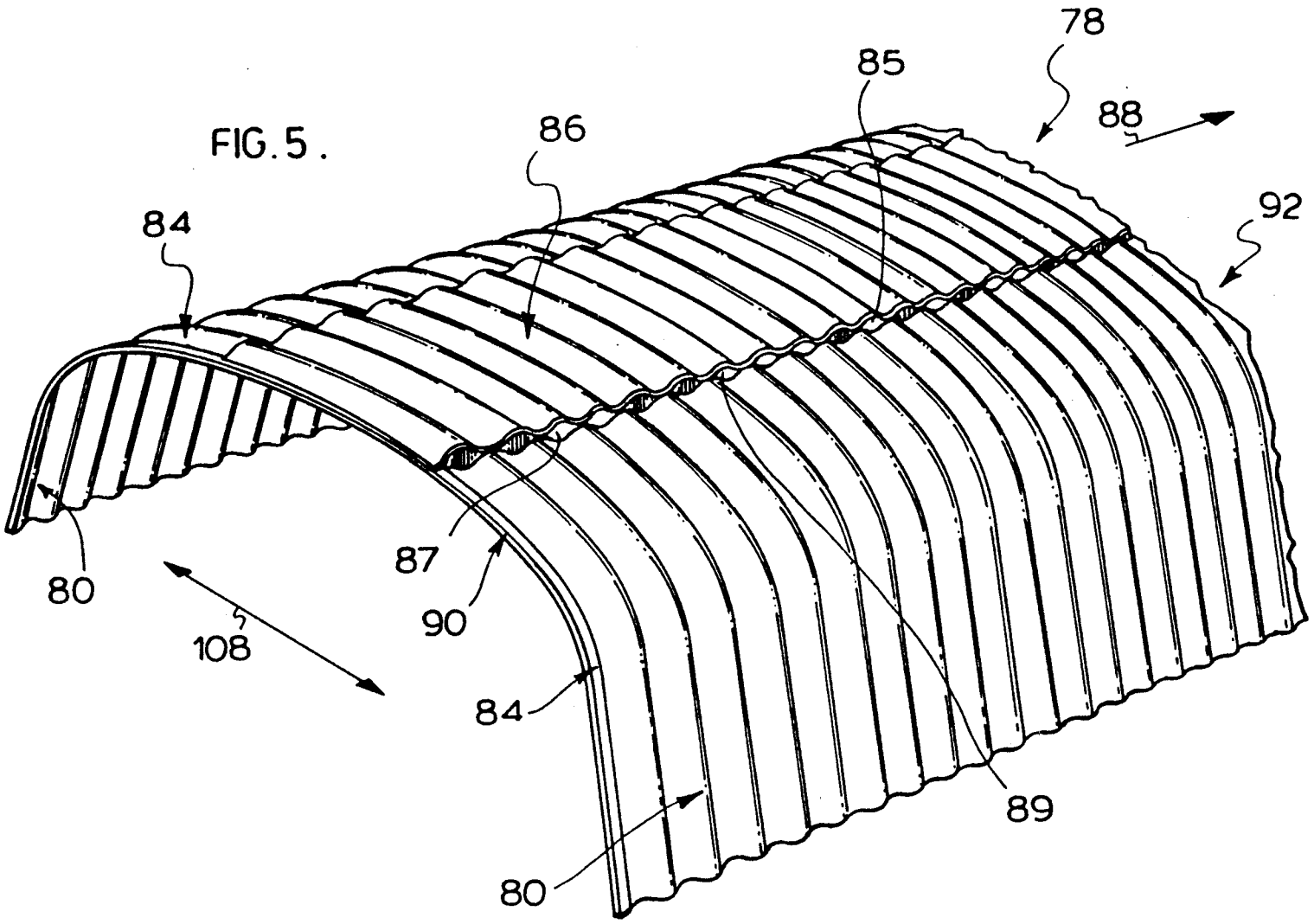
FIG. 5 is a perspective view of the continuously reinforced culvert design of this invention where reinforcement is applied to at least the crown of the box culvert.

As will now become apparent with respect to the discussion of the various embodiments of this invention in FIGS. 5 and onwards, a continuously reinforced structure of this invention optimizes the design features while continuing to carry maximum loads with spans which can exceed the generally accepted limitation of 8 m.

The box culvert reinforced in accordance with this invention is shown in perspective in FIG. 5. The box culvert 78 may assume the same overall cross-sectional shape of the reinforced type of box culvert of FIG. 1. The box culvert 78 has the usual sidewall portions 80 with the standard crown portion 82 and the opposite haunch portions 84, which are intermediate the respective sidewall 80 and crown 82. In accordance with this invention, a continuous reinforcement 86 is provided on the crown 82 and as will be described with respect to FIGS. 7 and 8, the extent of that continuous reinforcement may include only a major section of the crown or the entire span of the crown, possibly portions of the respective haunches and in some situations, may extend over the entire haunch portions and onto the sidewalls. The reinforcement 86 is continuous in the sense that it extends preferably the entire length of the culvert in the direction of arrow 88. By continuous, the reinforcement is uninterrupted in its extending from the front end, generally designated 90, to its back end generally designated 92. It is, of course, appreciated that the reinforcement is formed by erecting and connecting together a plurality of corrugated sheets. Normally those sheets are bolted together in the usual manner to form the interconnected, uninterrupted type of reinforcement. The continuous reinforcement 86 is also provided in separate sheets which are not only bolted together but also bolted to the culvert sheets as well, in manner to be discussed in more detail with respect to FIG. 6 and 9.

It is appreciated that the continuous reinforcement is required only along the length portion of the culvert which is carrying the load. If desired for landscape or water redirecting reason, unreinforced culvert sections may be added onto and extend outwardly from either or both ends of the reinforced length of culvert. There are also situations where the overburden may slope away from the surface at the angle of repose or less. Such overburden may extend outwardly a considerable distance and hence, require culvert beneath it. However, the combined live load (traffic weight on the surface) and the dead load (weight of overburden) may not extend or propagate out to the extremities defined by the overburden. Since the culvert need only be reinforced continuously for the section which is effectively supporting the live and dead loads, then to save on material and assembly costs the culvert length which is effective in supporting load, i.e., the live load and dead load defines the extent of reinforcement. Hence, in light overburden situations, the culvert length which is reinforced may be slightly greater than the width of the surface roadway. The dead load of the overburden to each side of the roadway may not be that heavy and can therefore be readily supported with unreinforced culvert sections. Alternatively, concrete head walls which are at the ends of the culvert or concrete collars to resist stream hydraulic pressure may be at the ends of the culvert would in most situations require the use of culvert continuous reinforcement from one end of the culvert to its other end.

The preferred embodiment of this invention as shown in FIG. 5 entails the use of corrugated metal sheet reinforcement secured to the culvert. With the corrugated reinforcement in place on the culvert, spaces are defined between the reinforcement and the culvert. The open ends 85 along each side of the reinforcement are closed off as at 87 to prevent water and/or backfill from accumulating between the reinforcement and the culvert. Preset closure plugs 89 may be inserted in each opening 85 to close off the sides of the reinforcement. The plug may be of metal or plastic. Alternatively, the sides could be closed off with various types of "in situ" formed foams such as polyurethane foams. It is appreciated, however, as will be discussed with respect to FIG. 9 that other shapes of metal sheet reinforcement as secured to the box culvert may be used. In addition, the sheets as provided in other shapes may be attached in various manners while still providing all of the advantages and features in a structure based on plastic design. Furthermore, the culvert design also permits the use of any of the standard types of culvert materials such as steel, aluminum alloys, coated steels and coated aluminums. Normally the steel plate thickness may be selected from the thickness of 3, 4, 5, 6 and 7 mm, whereas aluminum plate thickness may be selected from the thickness of 2.54, 3.18, 3.81, 4.45, 5.08, 5.75 and 6.35 mm.

Figure 6:
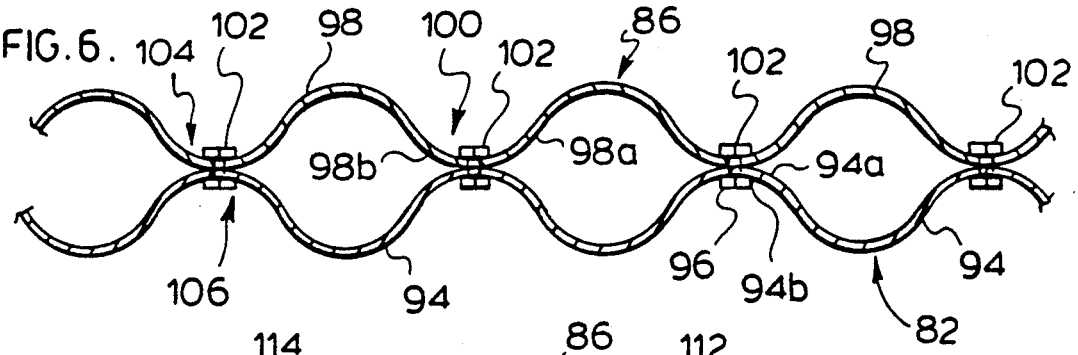
FIG. 6 is a section along the lines 6—6 of FIG. 5.

As shown in FIG. 6, which is a section along the line of 6-6 of FIG. 5, the crown portion 82 is formed with interconnected sheets 94. The sheets 94 may be interconnected in overlapped relationship as shown at the splice 96 for these sheets where sheet 94A overlaps a correspondingly curved portion 94B. The corrugations in these sheets 94 are of a sinusoidal shape and usually have a depth of 25 mm to 150 mm and a pitch in the range of 125 mm to 450 mm. The reinforcement 86 is made up of interconnected sheets 98 which, for example, overlap at splice 100 with any edge of sheet 98A overlying an edge of sheet 98B. The sheet splices are interconnected by nuts and bolts 102.

Preferably, although not necessary, as will be demonstrated with respect to FIG. 9, the reinforcement metal sheet 86 may have a corrugation profile the same as the corrugation profile on the sheets 94 for the crown, hence sheets 98 have a selected corrugation depth of 50 mm to 100 mm and, a pitch in the range of 150 mm to 450 mm. The two preferred corrugation profiles are i) 50 mm by 150 mm and ii) 140 mm by 381 mm. In accordance with this embodiment to provide sufficient interconnection of the reinforcement to the crown, the metal reinforcement sheet 98 has its valley or trough portions generally designated 104 secured to the crest portions generally designated 106 of the crown sheets 94 by bolts 102. Whereever the troughs of the reinforcement sheets abut the crests of the crown portion, bolt connections are made. Depending upon the design criteria and the loads to be carried by the box culvert, it may not be necessary to interconnect the reinforcement to the crown at each reinforcement trough or crown crest. For example, every second crown crest maybe skipped or perhaps ever second and third crest portions skipped with respect to connection. The spacing between the bolts along the span direction, generally designated 108 in FIG. 5 are sufficient to ensure that the reinforcement and crown portion behave as unitary structure when under load. This may result in a bolt spacing in the range of 400 mm to 1.2 m.

In accordance with this invention, it is the selective application of the reinforcement to the box culvert and, the fact that this reinforcement is continuous that provides significant advantages and features. As shown with respect to FIG. 7, the section of the culvert shows a relationship of the opposing sidewalls 80, the crown 82 and the opposite haunch portions 84, which are intermediate the crown and the respective side. The plastic moment profile under maximum possible load is indicated by line 108. The moment reaches a maximum value beneath the crown 82 in the area 110. The moment goes through a zero value where it intersects the crown at positions 112 and 114. The moment then increases through the haunch portions in regions 116 and 118 and reduces to zero at the base of the box culvert in the regions 120 and 122. By appropriate location of the continuous reinforcement 86, the maximum amount of the plastic moment in excess of 50% may be transferred to the crown within the region between positions 112 and 114 and, particularly in the central region 110. Approximately 50% or less of the moment is then distributed to the haunch and sidewall portions in the regions of 116 and 118.

The reinforcement 86 is preferably designed to reinforce the crown only to the extent defined by the zero moments at 112 and 114. It may even be possible that the reinforcement 86 does not span the crown out to and including positions 112 and 114. Usually the extent of reinforcement spans a major portion of the crown in the span direction. It is understood, however, as will be discussed with respect to FIG. 8, that the extent to which the continuous reinforcement covers the span of the box culvert can depend to some extent on load design and other structural characteristics that may be achieved in extending the reinforcement beyond the zero moment cross over points 112 and 114. This emphasizes the difference between the form of reinforcement in accordance with this invention compared to that of the prior art and in particular the prior art which involves the use of ribs or the like as shown in FIG. 1. In those reinforcement systems, the ribs encompass not only the crown but, the haunch and sidewall as well. Furthermore, the spacing between the ribs can vary depending upon the load designs. However, use of such ribs which are installed individually can consume considerable time during the erection process.

Figure 8:
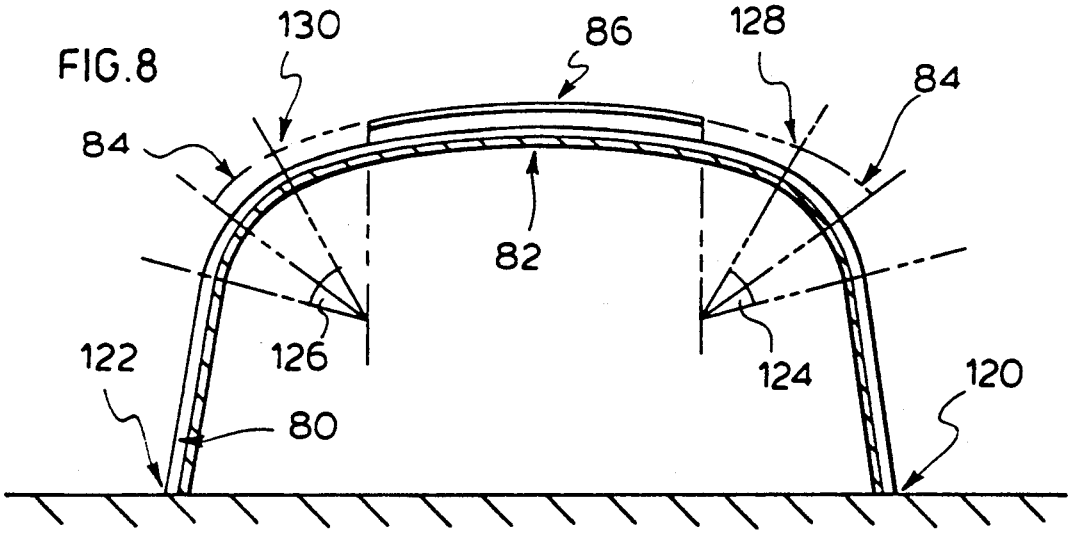
FIG. 8 is a section the same as FIG. 7 demonstrating the various extent of reinforcement on the crown, haunches and sidewalls of the box culvert.

With reference to FIG. 8, the haunch portions 84 are indicated by angles 124 and 126. The crown portion 82 extends between regions 128 and 130, where it is understood that the overlap in the sheets is staggered relative to positions 128 and 130 to provide maximum integrity in the structure with interconnected overlapping sheets. The extent to which the reinforcement 86 may overlap the crown 82, is guided by the zero-moment positions 128 and 130. The reinforcement, according to this invention, may extend further across the span such as overlapping portions of the haunches, or extending over the entirety of the haunches 84, or even contacting the sidewalls 80 in order to provide reinforcement on an uninterrupted basis along the length of the culvert. The continuous reinforcement is in the form of individual sheets which are joined end to end at staggered joints so that each reinforcement sheet may have a different arch length in extending over the haunches 84. Normally, in accordance with the preferred embodiment of the invention, the reinforcement sheets 86 usually extend out to the regions 112 and 114 of zero moment where it is understood that the zero moment regions may move towards or away from each other, depending upon the load requirements and the overall shape and span of the box culverts.

It is appreciated that various types of reinforcement may be used in place of the preferred type of corrugated reinforcement. There may be situations where material savings and/or in use criteria warrant an alternative shape for the reinforcement profile. The reason, however, that the corrugated sheet is preferred is that it minimizes inventory and simplifies fabrication of the culvert sections and the reinforcement. As can be appreciated if the reinforcement has the same corrugation profile as the sheets for the culvert and the reinforcement profile is of the same thickness material, then it is only necessary to warehouse a single thickness of material, for example, in steel this could be the 3 mm thickness material. The only difference in the sheets is the degree to which they are curved, depending upon their location in the box culvert cross-sectional shape. It is also appreciated that by virtue of this design, the machines used in forming the culvert sections may be of the break style of press and/or a roll forming press. These presses may be used in combination or separately to form the sections, the selection of the pressure is determined by the thickness of the material to be worked.

Figure 9A:
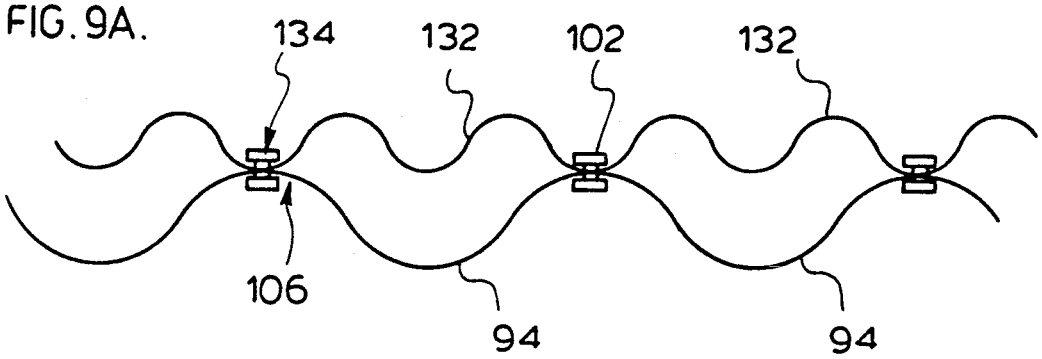
FIGS. 9A, B, C and D are sections similar to FIG. 6 to demonstrate various profiles for the continuous reinforcement secured to the culvert crown.
Figure 9B:
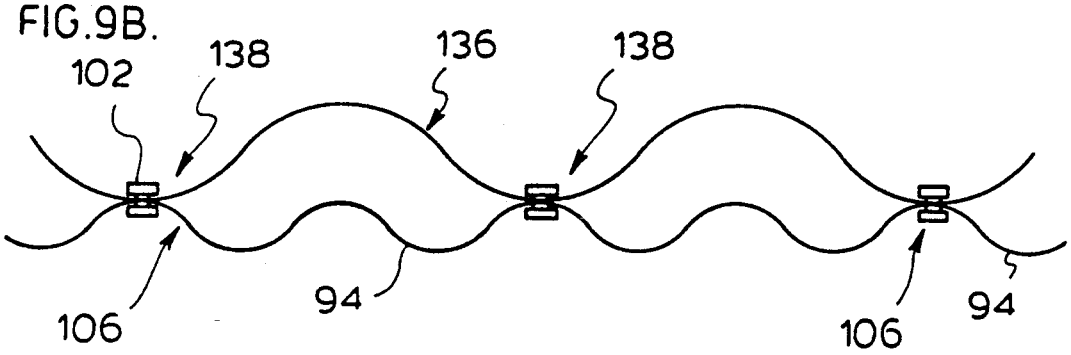
Figure 9C:
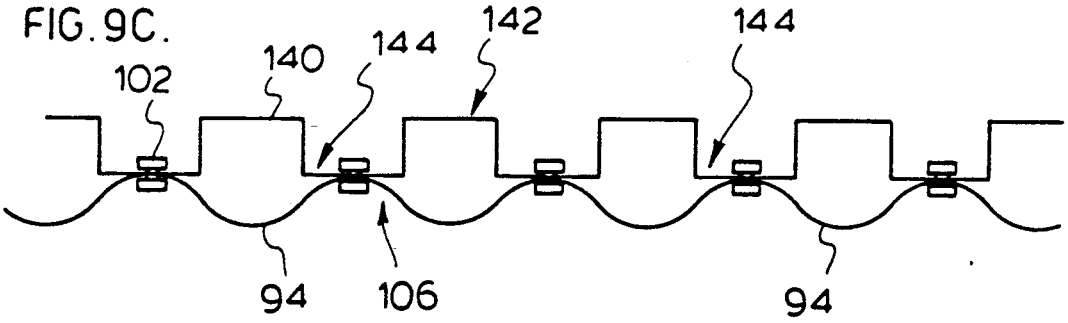

Examples of various other types of reinforcement shapes are shown in FIGS. 9A, 9B, 9C and 9D. In FIG. 9A, the sheets 94 have secured thereto corrugated sheets 132 which have a shallow depth of corrugation and a pitch of corrugation one half the pitch of sheets 94. At every second valley 134 of A metal or concrete floor may also be provided in the culvert. This type of floor may also be used to either anchor or assist in anchoring the culvert to the ground. A metal floor can be connected to the interior of or base of the sides. If a concrete floor is provided, the base of the culvert sides may be connected to the concrete. The preferred securement for the culvert base is shown in FIG. 10. The bottom portion 122 of sidewall 80, has its lowermost portion 148 bolted by way of bolt 150 to the footing generally designated to 152. The footing 152 comprises a corrugated steel plate 154 which extends the length of the culvert. The corrugated plate is secured to depending "L" shaped members 156 and 158. Each member has inwardly directed lip portion 160 and 162. The corrugated plate 154 is secured to the inwardly directed lips or ledges 160 and 162, preferably by bolts or the like. The depending members 156 and 158 have sidewalls portions 164 and 166. Preferably, the footings are positioned by digging two spaced-apart narrow trenches for the anticipated length of the structure. The depending members 156 and 158 are then located in the slot trenches where the spacing between the trenches accommodates the width for the base 154. The base 154 is then bolted to the numbers 156 and 158 whereby the native soil carries the load beneath base 154. Alternatively, a trench might be dug into which the footing sides 156 and 158 are placed. The bottom 170 of the trench maybe reasonably level along the length of the culvert and on which the lower portions 172 and 174 rest. Aggregate or back fill soil 176 may be placed between the side portions 164 and 166 of the footing. The corrugated plate 154 may then be bolted to ledges 160 and 162 to complete the assembly.

The lower end 148 of the culvert is attached to the footing plate 154, by use of a bracket 178. It has an upper leg 180 which is connected to the bottom 148 of the culvert 80 by bolt 150. Bracket 178 also has lower leg 182, which is connected to the footing plate 154, by bolt 184. The bracket 178 has its leg portions 180 and 182 at the angle which corresponds with the angle that the sidewall 80 of the culvert intersects the ground 168. sheet 132, it is connected to the corresponding crest 106 by the bolts 102. With reference to FIG. 9B, a corrugated sheet 136 is used which has a corrugation depth considerably greater and perhaps 4 times greater than the depth of the corrugation of sheets 94. The sheets 136 have a pitch which is twice the pitch of the corrugated sheets 94. In this particular embodiment, each valley 138 of the reinforcement corrugation is secured to every second crest 106 of the crown corrugations by the bolts 102. In FIG. 9C, a square shape of corrugation 140 is provided in the sheets 142 where the recess portion 144 of the reinforcement sheet is aligned with every crest 106 of the lower sheets 94. The recess portions 194 are connected to the crest 106 by the bolts 102. It is also understood that the reinforcing principle in using a square shape of corrugation may also be achieved with other box-like shapes such as a trapezoidal shape or converging sides for the section of the box-like corrugation. The wider portion of the trapizoidal shape or converging side shape would be connected to the corresponding crest of the crown where it is understood that these shapes and others like them constitute a corrugation in the sheet. It is also understood that the reinforcement of the type shown in FIG. 6 may be nested in the crown portion so that the valley 104 of sheet 86 is nested in the valley 94 of sheet 96. In this nested relationship, the overhead clearance for the box culvert is minimal.

Figure 9D:
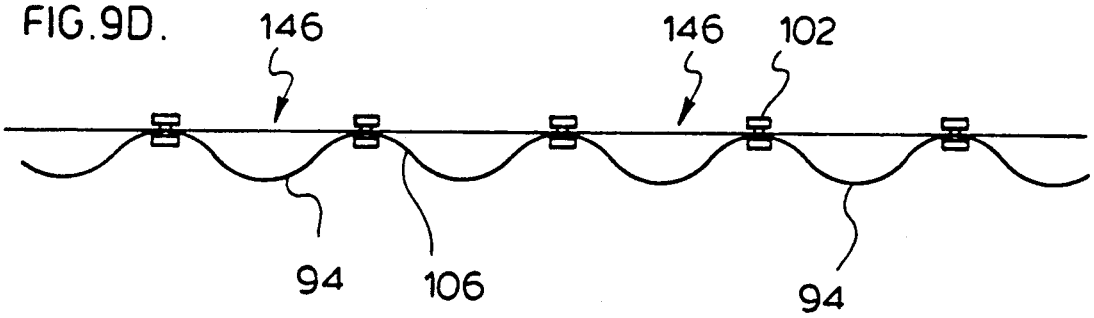
Figure 10:
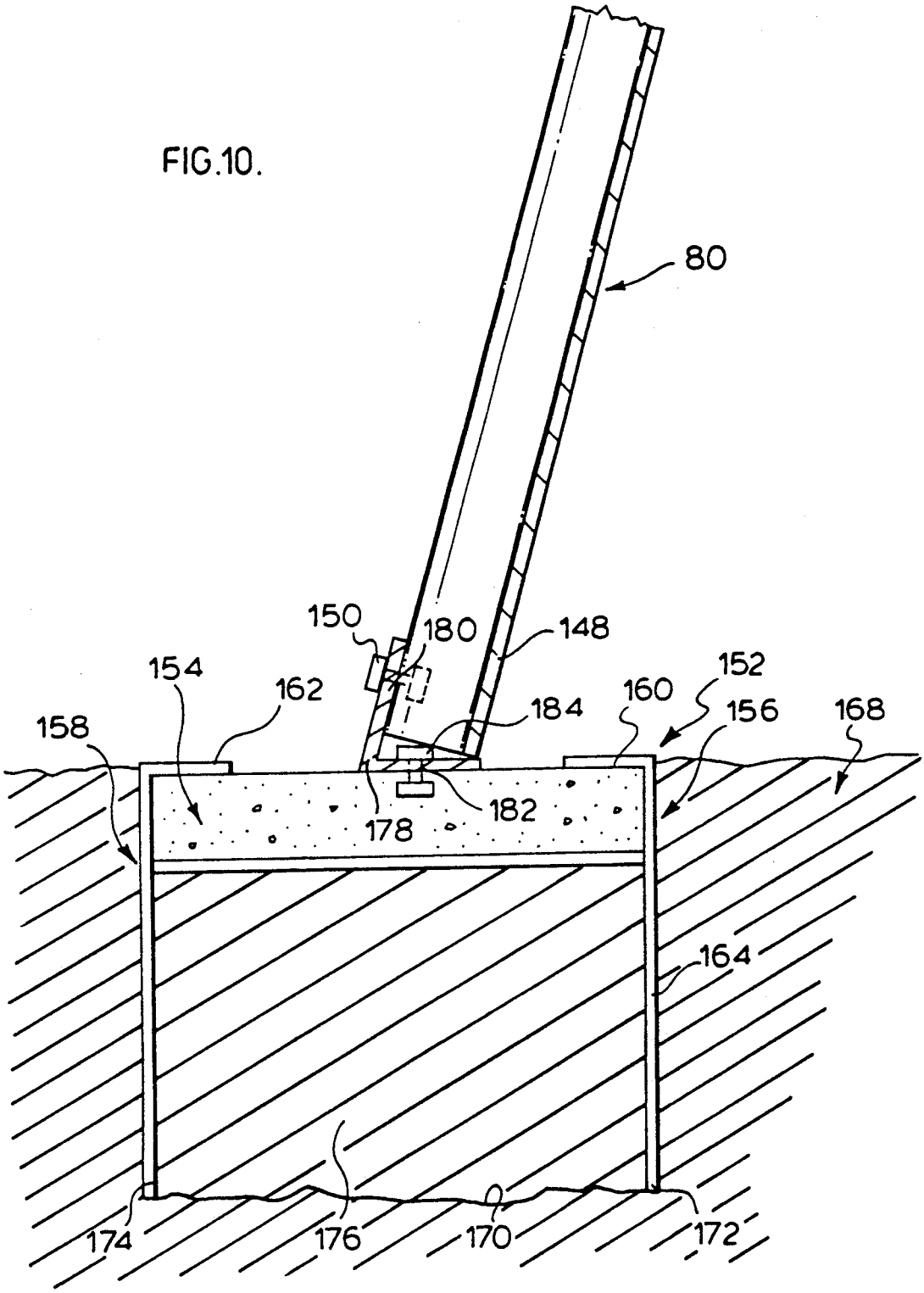
FIG. 10 is a section through a footing for the bottom portion of the culvert sides.

In other design situations such as shown in FIG. 9D, a smooth exterior at least in the crown portion area of the culvert may be desired. Hence, a flat reinforcement in the form of sheets 146 are secured to the crest 106 of the sheets 94 by the use of the bolts 102. Although the flat sheets 106 do not resist bending to the extent that the corrugated sheets of the embodiments in FIGS. 9A through 9C, it is understood that the flat sheet may be desirable for lighter loads where material costs are to be reduced.

There are a variety of techniques available for securing the both portions 120 and 122 of the culvert to the ground for example, by simply burying the sections in the ground providing aggregate footings in which they are buried, securing them with concrete in place or bolting them to concrete footing.

Figure 7:
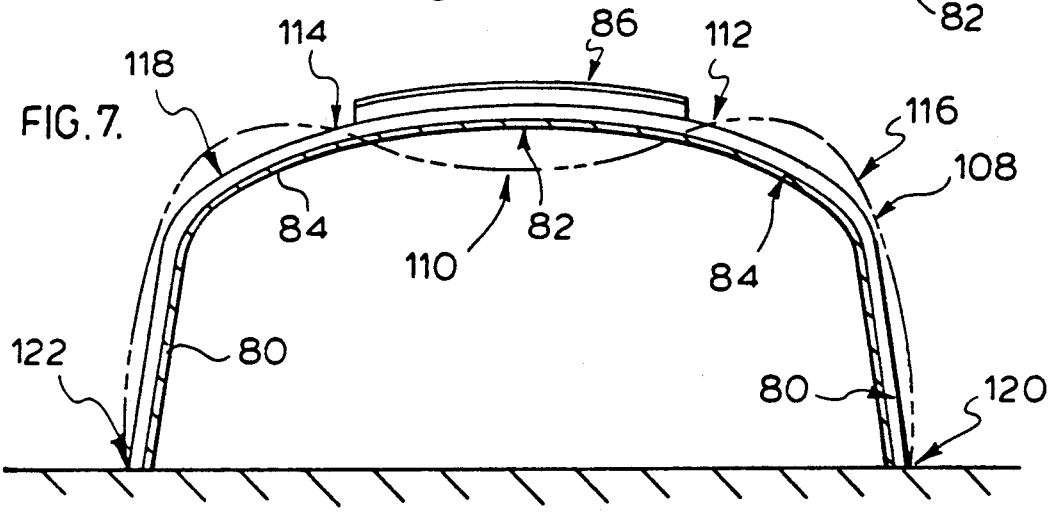
FIG. 7 is a section through the box culvert showing the reinforcement in place and the plastic moment when under load.

The footing 152 of FIG. 10 provides the least amount of interruption in the soil and does not require any special back fill composites, granular or concrete to complete the installation. The footings may be installed with minimal distribution to the surrounding soil and particularly stream beds, which render the footing preferable from the standpoint of environmental concerns. The footing is also preferred from the stand point of remote installations and not requiring special materials to complete. The significant advantage in the footing is the provision of the opposing sidewalls 164 and 166 of the footing as they extend the length of the culvert. Any loads applied to the culvert are transmitted through the sidewalls to the corrugated footing plate 154. This downwardly directed force is resisted by the footing 152 and by the soil 176 which is compacted between the plates 164 and 166. The plates 164 and 166 serve to contain the soil 176 so that the soil is not pushed outwardly from underneath the footing plate. This is a significant advantage over the normal types of granular and/or flat plate concrete pad types of footings used in the past. Hence, the plastic moments as designed for in FIG. 7 are retained in the structure during its useful life. It is appreciated that the corrugated footing plate 154 may have corrugations of a profile similar to that used in the box culvert sheets to again minimize material, warehousing costs and as well, tooling to form the corrugations. In addition, if a floor is required in the base of the culvert, a concrete pad may be poured between the footings where the inner opposing plates 164 function to contain the concrete along the sides during the concrete pour. If the floor is of corrugated metal, the metal sheets can be connected to the footing inner walls 164 by bolts and suitable angle clips.

The box culvert design according to this invention involving the use of continuous uninterrupted reinforcement achieves advantages and features which could not be realized by prior art structures. Most importantly, the design permits box culvert spans exceeding 7 to 8 meters. There is minimal, if any, waste of reinforcement because knowing the maximum plastic moment of the box culvert as shown with in FIG. 7, the reinforcement may be ended at regions 112 and 114 and are not required to extend beyond those zero moment points in the culvert crown and/or haunch sections. In the ability to use thinner gauge material, in the sidewalls, haunch, crown and reinforcement sections, by virtue of the continuous nature of the reinforcement, reduced radius of curvatures may be provided in the haunch portions without running the risk of microcracking or fissuring in the form material. Hence, the continuous metal reinforcement enables one to meet more closely the requirements of the plastic moment profile, thereby providing a more economical structure, yet having the load carrying capacities of the prior art structures.

Another significant advantage in the use of continuous reinforcement is that, the shapes as described may be bolted to the metal sheets of the crown by use of conventional tools. As shown in FIG. 6, there is unimpeded access to the bolts 102 as used in connecting the reinforcement to the culvert. This avoids the disadvantages in connection with the type of "L" shaped reinforcement ribs used in the prior art devices of FIG. 2, where access to the bolt head can be impeded by the leg members of the "L" shaped reinforcing ribs. Due to the more limited extent in the use of reinforcement along the crown portion of the culvert and, that the continuous reinforcement as applied to the crown portion has a lesser radius of curvature results in minimal working of the reinforcement. Furthermore, in the connection of the continuous metal reinforcement to the culvert, there is a uniform stiffness and uniform deflection provided in the culvert so that there is little, if any, angulation or deflection along the culvert length. Also, with this continuous reinforcement, it is possible to design the culvert by virtue of rational analysis without the need for testing. It is also understood that the actual stress in the corrugated plate is only along one axis, which provides greater strength as compared to prior art reinforced structures. Also, the use of continuous metal reinforcement is preferable to concrete reinforcement because the concrete reinforcement is not ductile.

Although preferred embodiments of the invention are described herein in detail, it will be understood by those skilled in the art that variations may be made hereto without departing from the spirit of the invention or the scope of the appended claims.

We claim:

1. In a reinforced metal box culvert having a length and being characterized by having a crown, opposing sides and opposite curved haunches, each said haunch being intermediate said crown and a corresponding said side, and spaced apart reinforcing members applied to exterior portions of said box culvert sides, haunches and crown, said box culvert crown, opposing sides and opposite haunches being of corrugated metal sheet sections which are of the same or different thickness in metal and having similar corrugated profiles, said metal sheet corrugations extending parallel to culvert span and said metal sheets being secured in nested overlapping relation, the improvement comprising:

i) corrugated metal sheet reinforcement secured to at least said crown and extending continuously along said crown in the direction of the culvert length where such extension of sheet reinforcement is for a culvert length which is effectively supporting load, ii) said corrugated metal sheet reinforcement having a corrugation profile which abuts at least said corrugated crown with troughs of said reinforcement sheet secured to crests of said corrugated crown along said culvert length, iii) said corrugated metal sheet reinforcement having a curvature complementary to said corrugated crown to facilitate thereby securement of said troughs abutting said crests, iv) said corrugated metal sheet reinforcement extending continuously along said culvert length in an uninterrupted manner to provide an optimum load carrying capacity for a selected extent of reinforcement provided by said corrugated metal sheet reinforcement secured to at least said corrugated crown.

2. In a reinforced metal box culvert of claim 1, said selected extent of reinforcement is provided by said corrugated metal sheet reinforcement being secured to said corrugated crown and spanning at least an upper portion of said crown.

3. In a reinforced metal box culvert of claim 1, said selected extent of reinforcement being provided by said corrugated metal sheet reinforcement being secured onto said corrugated crown and onto said opposite haunches.

4. In a reinforced metal box culvert of claim 1, said corrugated metal sheet reinforcement having a corrugation profile similar to said crown corrugation profile.

5. In a reinforced metal box culvert of claim 4, said corrugated metal sheet reinforcement and said crown, opposite haunches and opposing sides having corrugation profiles which are sinusoidal in section.

6. In a reinforced metal box culvert of claim 1, said corrugated metal sheet reinforcement having a pitch spacing between adjacent corrugations which is at least one-half the pitch spacing between adjacent corrugations of said crown.

7. In a reinforced metal box culvert of claim 1, said crown, opposite haunches and opposing sides having a corrugation profile defined by the parameters of a 25 mm to 150 mm depth and a 125 m to 450 mm pitch.

8. In a reinforced metal box culvert of claim 1, said corrugated metal sheet reinforcement having same depth and pitch corrugations as said crown haunch and said corrugation profile.

9. In a reinforced metal box culvert of claim 1, said nested overlapping portions of said metal sheets and said abutting portions of said corrugated metal sheet reinforcement being secured by fasteners.

10. In a reinforced metal box culvert of claim 1, said selected extent of reinforcement provided by said corrugated metal sheet reinforcement ranging from 50% to 70% of a culvert partial span which spans said crown and said opposite haunches.

11. In a reinforced metal box culvert of claim 7, said selected extent of reinforcement provided by said corrugated metal sheet reinforcement being in the range of 65% to 70%, said culvert having a span in excess of 8 m.

12. In a reinforced metal box culvert of claim 11, said corrugation profile having a depth in the range of 100 mm to 150 mm and a pitch in the range of 300 mm to 400 mm.

13. In a reinforced metal box culvert of claim 1, said haunch has an included angle ranging from 30° to 90°.

14. In a reinforced metal box culvert of claim 13, said haunch has a radius of curvature in the range of 0.6 m to 1.2 m.

15. In a reinforced metal box culvert of claim 1, said crown, opposite haunches and opposing sides and said corrugated metal sheet reinforcement all being of the same thickness.

16. In a reinforced metal box culvert of claim 15, said thickness range being from 3 mm to 7 mm.

17. In a reinforced metal box culvert of claim 1, said sections of corrugated metal sheet being secured together by nuts and bolts extending through aligned apertures in said overlapping portions and through said corrugated metal sheet reinforcement.

18. In a reinforced metal box culvert of claim 1, said culvert sides having bottom edge portions resting on culvert footings extending along said culvert length, said culvert footing comprising:

i) a base of corrugated metal with its corrugations extending parallel with said culvert span, ii) spaced apart depending soil retention metal sheets, each said retention sheet being secured to a corresponding side of said base along its length, iii) means for fastening each of said soil retention sheets to said base, iv) means for fastening said bottom edge portion of each culvert side to said base.

19. In a reinforced metal box culvert of claim 18, said base having a corrugation profile similar to said corrugation profile of said culvert.

20. In a reinforced metal box culvert of claim 18, said soil retention metal sheets extending below said base by at least 300 mm.

* * * * *